US008698075B2

(12) United States Patent
Kurulugama et al.

(10) Patent No.: US 8,698,075 B2
(45) Date of Patent: Apr. 15, 2014

(54) ORTHOGONAL ION INJECTION APPARATUS AND PROCESS

(75) Inventors: Ruwan T. Kurulugama, Richland, WA (US); Mikhail E. Belov, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 456 days.

(21) Appl. No.: 13/114,869

(22) Filed: May 24, 2011

(65) Prior Publication Data

US 2012/0298853 A1 Nov. 29, 2012

(51) Int. Cl.
*H01J 49/06* (2006.01)

(52) U.S. Cl.
CPC ..... *H01J 49/065* (2013.01)
USPC ..... 250/292

(58) Field of Classification Search
USPC ..... 250/281–300
See application file for complete search history.

(56) References Cited

U.S. PATENT DOCUMENTS 5,495,108 A * 2/1996 Apffel et al. ..... 250/288
6,803,565 B2 * 10/2004 Smith et al. ..... 250/288
7,459,693 B2 12/2008 Park et al.
7,495,212 B2 2/2009 Kim et al.
7,504,640 B2 * 3/2009 Franzen et al. ..... 250/288
7,514,673 B2 * 4/2009 Senko et al. ..... 250/281

OTHER PUBLICATIONS

Kelly et al., "The Ion Funnel: Theory, Implementations, and Applications", Mass Spectrometry Reviews, 2010, 29, Apr. 23, 2009, pp. 294-312.*

* cited by examiner

*Primary Examiner* — Jack Berman
(74) *Attorney, Agent, or Firm* — James D. Matheson

(57) ABSTRACT

An orthogonal ion injection apparatus and process are described in which ions are directly injected into an ion guide orthogonal to the ion guide axis through an inlet opening located on a side of the ion guide. The end of the heated capillary is placed inside the ion guide such that the ions are directly injected into DC and RF fields inside the ion guide, which efficiently confines ions inside the ion guide. Liquid droplets created by the ionization source that are carried through the capillary into the ion guide are removed from the ion guide by a strong directional gas flow through an inlet opening on the opposite side of the ion guide. Strong DC and RF fields divert ions into the ion guide. In-guide orthogonal injection yields a noise level that is a factor of 1.5 to 2 lower than conventional inline injection known in the art. Signal intensities for low m/z ions are greater compared to convention inline injection under the same processing conditions.

15 Claims, 11 Drawing Sheets

ORTHOGONAL ION INJECTION APPARATUS AND PROCESS

This invention was made with Government support under Contract DE-AC05-76RLO1830 awarded by the U.S. Department of Energy. The Government has certain rights in the invention.

FIELD OF THE INVENTION

The present invention relates generally to instrumentation and methods for guiding and focusing ions in the gas phase. More particularly, the invention relates to a process for injection of ions into on guides for sensitive and robust mass spectral analysis that provides enhanced instrument stability.

BACKGROUND OF THE INVENTION

Electrospray ionization (ESI) sources that are coupled to on funnels often use an inline capillary (e.g., single or multiple) to introduce ions into the mass spectrometer (MS). FIG. 1 shows a conventional inline approach, in which a heated capillary is used to introduce ions from the ESI source directly into the ion funnel. The ion funnel then efficiently introduces ions into the mass spectrometer. However, when an inline capillary is used to introduce ions into the ion funnel, any incompletely desolvated liquid droplets generated by the ESI are inadvertently entered into the ion funnel and subsequently carried into the mass spectrometer due to the pressure gradient. In line approaches can thus cause contamination of downstream components of mass spectrometers. Contamination is greatest when the capillary, the ion funnel, the mass spectrometer, and other mass spectrometer elements are inline. This problem is more pronounced with multiple inlet capillaries used to increase the analyte signal, as multiple inlet capillaries significantly increase the quantity of ions introduced into the mass spectrometer, e.g., by as much as five-fold compared to single inlet capillaries with the same internal diameter (I.D.). The introduction of large volumes of gas can lead to rapid contamination of downstream mass spectrometer elements, thereby resulting in unstable signals, signal loss, and eventual complete loss of signal. One approach to mitigate contamination of downstream mass spectrometer elements is to place a jet disrupter into the ion funnel. However, the jet-disrupter also becomes contaminated. And, since the jet disruptor does not completely block liquid droplets and neutrals going into the mass spectrometer, this configuration still leads to contamination of mass spectrometer elements and to signal deterioration over time.

FIG. 2 shows an ion injection approach known in the art that incorporates an inlet capillary placed between a repeller plate and a first electrode orthogonal to the entrance of the ion funnel. In this configuration, the repeller plate is parallel to the first electrode of the ion funnel at a distance of approximately 12 mm. Both the repeller plate and first electrode are energized with DC only potentials. A strong electric field between the repeller and the entrance to the ion funnel diverts ions into the ion funnel. However, when a multiple inlet capillary, or a larger (e.g., 1 mm I.D.) single inlet capillary is used, this ion injection approach does not perform as expected. Evaluation shows the signal intensity reaches a lower threshold compared with a single inlet capillary of the same I.D., as the DC field between the repeller electrode and the first funnel electrode is insufficient to oppose drag forces resulting from the greater gas loads generated by the multiple inlet capillary. Therefore, the DC field does not properly divert ions into the ion funnel at increased gas loads. And, practical limitations such as electrical discharge occur at higher electric fields which also limits DC fields that can be placed between the repeller electrode and the first ion funnel electrode. Accordingly, new inlet designs are needed that permit higher gas loads but do not increase the risk of contamination of downstream elements.

SUMMARY OF THE INVENTION

The invention includes a device that provides orthogonal ion injection. The device includes an ion guide defined by a plurality of stacked electrode lenses. Each electrode lens includes a preselected diameter, an entrance end, and an exit end. In some embodiments, the electrode lenses have a diameter between about 0.10 inches (2.5 mm) and about 3 inches (7.62 cm). The electrode lenses collectively define an ion guide axis through the center of the ion guide. The device also includes an inlet capillary constructed of a preselected material. The inlet capillary inserts through an opening at a preselected location downstream from a first electrode lens on one side of the ion guide introducing ions into the interior of the ion guide orthogonal to the ion guide axis. The opening includes a shield that covers the opening composed of an insulating material. In a preferred embodiment, the shield is composed of a poly-ether-ether-ketone (PEEK) polymer. The shield preferably has a width defined by an odd number of electrode lenses in the ion guide. In some embodiments, the shield is positioned between two even numbered electrode lenses of the ion guide.

In some embodiments, the inlet capillary is a single inlet capillary of a larger I.D. (e.g., 1 mm). In other embodiments, the inlet capillary is a multiple inlet capillary that improves sensitivity in MS systems. The invention can further be adapted for use in dual source systems where matrix assisted laser desorption ionization (MALDI) and ESI techniques are implemented in the same source.

In a preferred embodiment, capillaries of the multiple inlet capillary are disposed vertically such that ions delivered through a first capillary are decoupled from ions delivered through a different capillary of the multiple inlet capillary.

In some embodiments, electrode elements of the ion guide include both a DC and an RF potential, which minimizes risk of contamination in downstream electrode elements and MS components. In some embodiments, electrode lenses employ both an RF field and a DC field of a preselected strength that drives ions introduced from the end of the inlet capillary into the ion guide along the ion guide axis orthogonal to the original ion direction.

In various embodiments, the DC field and RF field are applied simultaneously to each of the electrode lenses of the ion guide. In some embodiments, the DC field is applied to each of the electrode lenses of the ion guide independently from the RF field applied to each of the electrode lenses of the ion guide. In various embodiments, the DC field is a DC gradient selected between about 10 V/cm and about 15 V/cm. In various embodiments, the DC field is a DC gradient selected between about 20 V/cm and about 50 V/cm.

In some embodiments, the RF field on any electrode lens is 180 degrees out of phase with the RF field on an adjacent electrode lens in the ion guide. In various embodiments, the RF field includes an RF frequency selected between about 600 kHz and about 1000 kHz. In various embodiments, the RF field includes an RF frequency selected between about 1000 kHz and about 2000 kHz. In some embodiments, the RF field on the electrode lenses is defined by an RF frequency of up to about 1 MHz with an amplitude defined by a peak-to-peak voltage of up to about 250 Volts.

In some embodiments, a repeller electrode placed in front of a first electrode lens of the ion guide delivers a DC voltage and an RF frequency of a preselected amplitude that directs ions from the ion inlet capillary into the ion guide along the ion guide axis.

In some embodiments, the repeller electrode includes a metal mesh or a solid metal plate. The inlet capillary is placed inside the ion guide such that ions are directly injected into the DC and RF fields inside the ion guide. The RF field provides efficient confinement of ions inside the ion guide. The RF phase is identical on electrode lenses directly adjacent the shield on either side of the shield in the ion guide. In some embodiments, the ion guide is enclosed within an ion guide chamber.

In various embodiments, pressures within the ion guide chamber are selected between about 0.1 Torr and about 30 Torr.

In various embodiments, the ion guide includes a pumping port located on a wall of the ion guide chamber opposite the inlet capillary that removes liquid droplets and excess gas introduced to the ion guide through the inlet capillary.

In some embodiments, the ion guide is a tandem ion guide that includes a first ion guide located within a first vacuum chamber at a first higher pressure and a second ion guide located within a second vacuum chamber at a second lower pressure.

In some embodiments, the separation distance between adjacent electrode lenses in the ion guide defines a flow path for removal of liquid droplets and excess gases introduced from the inlet capillary. Any large diameter liquid droplets (i.e., above 10 μm) resulting from ionization of the sample from the ion source (e.g., ESI) that are introduced through the inlet capillary into the ion guide are removed. Strong directional gas flow at the end of the inlet capillary carries these liquid droplets out of the ion guide through openings created by partially open spacers between the electrode lenses.

In some embodiments, a pumping port (opening) located on the wall of the ion guide chamber opposite the single or multiple inlet capillary maximizes removal of excess gas and liquid droplets from the ion guide. In another embodiment, the pumping port is located opposite and downstream of the inlet capillary to enable curved directional gas flow that improves ion injection efficiency into the ion guide. In some embodiments, the flow path for removal of liquid droplets and excess gas is defined along at least one side along the length of the ion guide or a portion thereof. In some embodiments, the flow path for removal of liquid droplets and excess gas is defined along at least two sides along the length of the ion guide or portions thereof.

In some embodiments, the ion guide is of a tandem ion guide that includes a first ion guide and a second ion guide coupled together. In some embodiments, the first ion guide is at a higher pressure relative to the second ion guide. In various embodiments, the first ion guide includes a pressure selected between about 4 Torr and about 30 Torr. In various embodiments, the second ion guide includes a pressure selected between about 1 Torr and about 4 Torr. In some embodiments, the first ion guide has a conductance limit electrode lens that couples the first ion guide to the second ion guide with a diameter between about 2.5 mm and about 3.0 mm.

The invention also includes a process for introducing ions orthogonally into an ion guide. The process includes introducing ions between two electrode lenses of an ion guide at a preselected location downstream from a first electrode lens of the ion guide orthogonal to the ion guide axis, and simultaneously applying a preselected DC field and RF field to electrode lenses of the ion guide to drive ions along the ion guide axis in a direction orthogonal o the original ion direction.

In some embodiments, ions are introduced through an opening between two selected electrode lenses at a preselected location on one side of the ion guide into the interior of the ion guide orthogonal to the ion guide axis.

In some embodiments, ions from the ionization source are injected directly into the DC and RF fields inside the ion guide such that ions are confined along the ion guide axis within the ion guide.

In various embodiments, preselected DC fields and RF potentials are applied to each of the electrode lenses of the ion guide to drive orthogonally introduced ions into the ion guide along the ion guide axis orthogonal to the original ion direction.

The present invention accommodates greater gas loads in concert with a larger (e.g., 1 mm) acceptance inlet capillary thereby improving the sensitivity of the system while reducing noise and contamination.

In various embodiments, excess gas and liquid droplets is removed from the ion guide to minimize contamination of downstream components. The process improves transmission efficiency while simultaneously minimizing potential for contamination of the ion guide and down-stream mass spectrometer elements.

The present invention produces lower noise levels with multiple inlet capillaries compared with conventional inline injection approaches. In some embodiments, noise level is lower by a factor of about 2. Also, the present invention yields greater signal intensities for low m/z ions compared to inline injection approaches under the same conditions.

DETAILED DESCRIPTION

The present invention includes an orthogonal ion injection device and process for introducing ions into an ion guide that minimizes contamination of downstream mass spectrometer elements that normally would result in unstable signals and loss of signal over time. The present invention solves contamination problems known in the art by preventing liquid droplets generated by the ionization source (e.g., ESI sources) from entering into the mass spectrometer. While the present invention is described in reference to specific embodiments configured with a specific type of ion guide (e.g., an electrodynamic ion funnel), the invention is not limited thereto. For example, the invention can deliver ions in concert with various ion guides including, but not limited to, e.g., electrodynamic ion funnels, ion funnel traps, tandem ion funnels, S-lenses, stacked ring ion guides, including combinations of these various ion guides and associated components. Thus, all modifications as will be made or envisioned by those of ordinary skill in the art in view of the disclosure are encompassed hereby.

Figure 1:
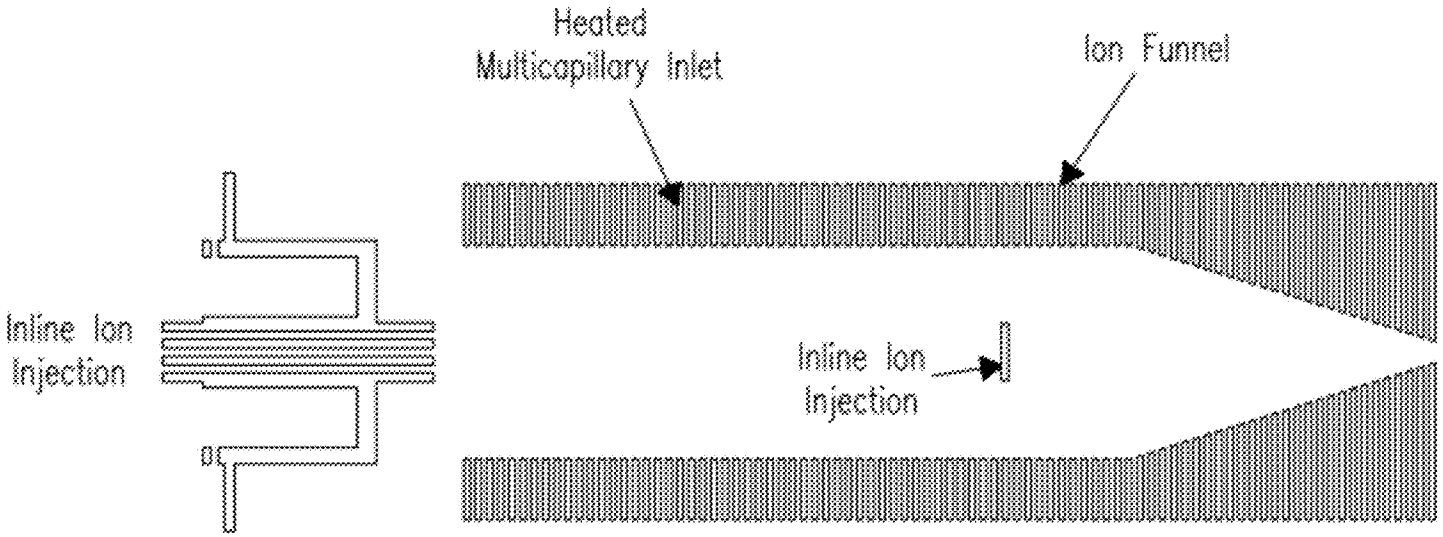
Fig. 1 (Prior Art)
FIG. 1 (prior art) shows a conventional inline injection approach.
Figure 2:
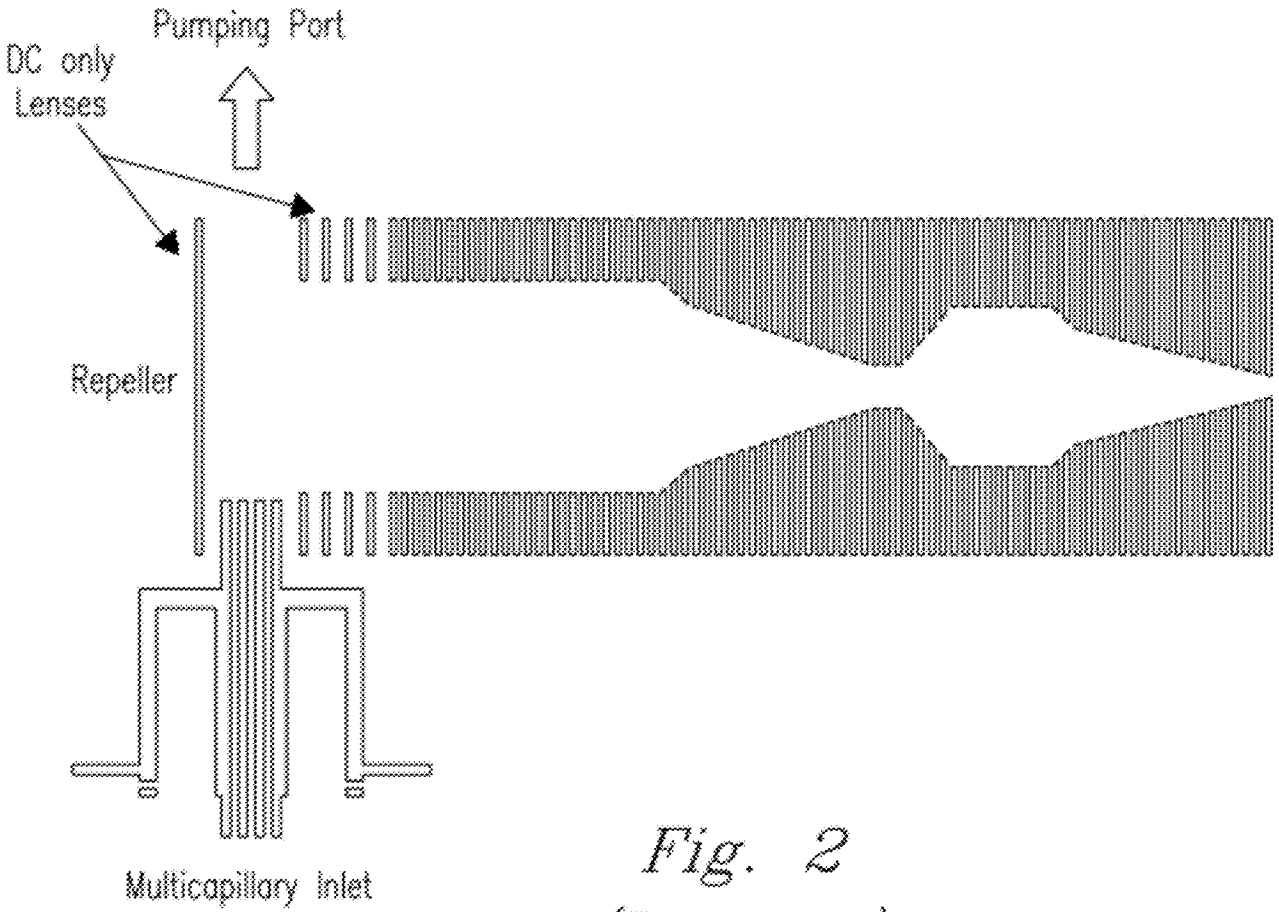
Fig. 2 (Prior Art)
FIG. 2 (prior art) shows an orthogonal injection approach known in the art.
Figure 3A:
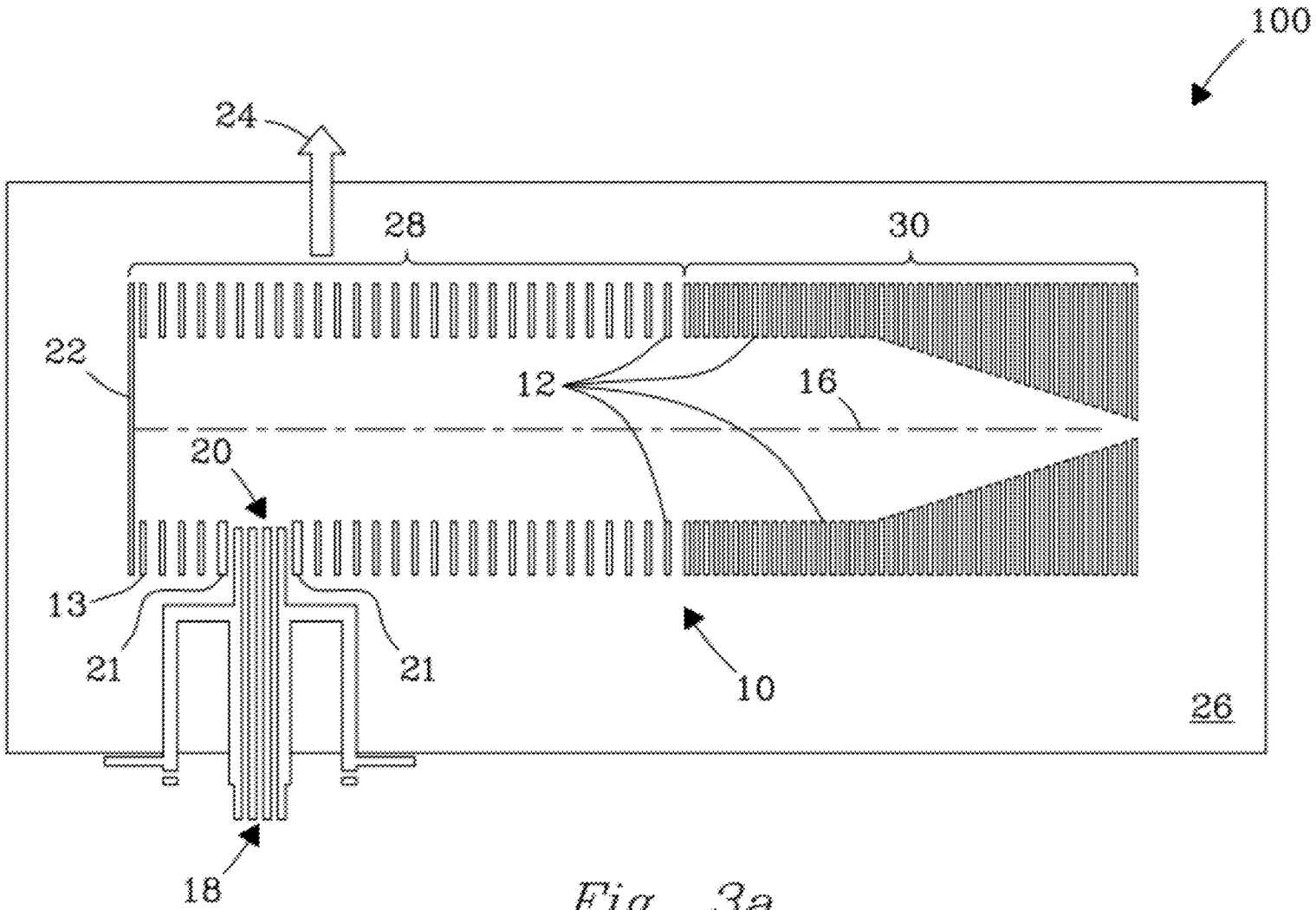
FIGS. 3*a*-3*d* present different views of an orthogonal on injection device and selected components, according to an embodiment of the invention.

FIG. 3*a* is a schematic showing an orthogonal ion injection device 100 of an in-guide design, according to one embodiment of the invention. In the instant embodiment, device 100 includes an ion guide 10, e.g., an ion funnel 10, that includes a selected and variable number of concentric electrode lenses 12. Electrode lenses 12 collectively define an ion guide axis 16 through the center of ion guide 10. An inlet capillary 18 (e.g., single or multiple capillary) inserts through an opening 18 on one side of the ion guide 10 at a preselected location downstream from a first electrode lens 13 of the ion guide 10 into the interior of the ion guide 10. Inlet capillary 18 introduces ions received, e.g., from an ESI source, into ion guide 10 at an angle that is orthogonal to the ion guide axis 16. Ions are directly injected into DC and RF fields inside ion guide 10. The present invention provides a 2- to 5-fold better ion transmission efficiency compared with a prior orthogonal injection approach (Bruker Daltonics), while minimizing contamination of downstream components including, e.g., coupled ion guides, and mass spectrometer components. In some embodiments, inlet capillary 18 is a heated capillary, but is not limited thereto. Inlet opening 20 inserts partially into ion guide 10 and is shielded with an insulating material to prevent any discharge between the inlet capillary 18 and adjacent ion guide electrodes 12 that can interfere with movement of ions into the ion guide 10. Shape of electrode lenses 12 is not limited. In some embodiments, electrode lenses 12 are round with preferred inner diameters (I.D.) of between about 3 mm and about 19 mm. In some embodiments, electrode lenses 12 have preferred diameters from about 25.4 mm (1 inch) to about 50.1 mm (2 inches).

Ion guides 10 also have various lengths. In some embodiments, preferred lengths of the ion guide are from about 8 cm to about 10 cm. In other embodiments, length of the ion guide 10 is about 15 cm. Device 100 further includes a repeller electrode (plate) 22 positioned at the leading edge in front of a first electrode lens 13 of ion guide 10 that diverts ions introduced through inlet capillary 18 into on guide 10 along on guide axis 16. Device 100 further includes a pumping port 24 that is positioned on a side of the on guide chamber (FIG. 3*b*) opposite inlet capillary 18 that couples to a pump (not shown) for removing liquid droplets, neutrals, and excess gas introduced from the ionization source (e.g., ESI source) (not shown) from on guide 10, which minimizes contamination of downstream components including on optics and mass-selective detectors of the mass spectrometer. In the present embodiment, top (extension) portion 26 includes concentric ring electrodes 12 of a preselected size with a spacing of about 0.5 mm to about 1.0 mm between each electrode lens 12 that allows air (gas) and liquid droplets introduced from the ionization source to pass through spacing 30 and be removed from on guide 10.

Ion guide 10 employs two parallel resistor networks, each coupled to a single RF phase waveform. DC potentials are applied to electrode lenses 12 through these resistor networks. RF potentials are applied to electrode lenses 12 of the on guide 10 through a capacitor network. Each lens 12 is connected to the appropriate waveform of an RF generator through a capacitor of the capacitor network. This arrangement eliminates Joule heating of the resistor networks at elevated RF potentials above about 100 $V_{p-p}$. Elevated RF potentials are required for efficient operation of on guides at higher pressures (e.g., >4 Torr). The RF fields provide confinement of ions introduced into ion guide 10. DC fields direct ions through on guide 10 along on guide axis 16 into downstream components including, e.g., downstream ion guides and a downstream mass spectrometer.

Figure 3B:
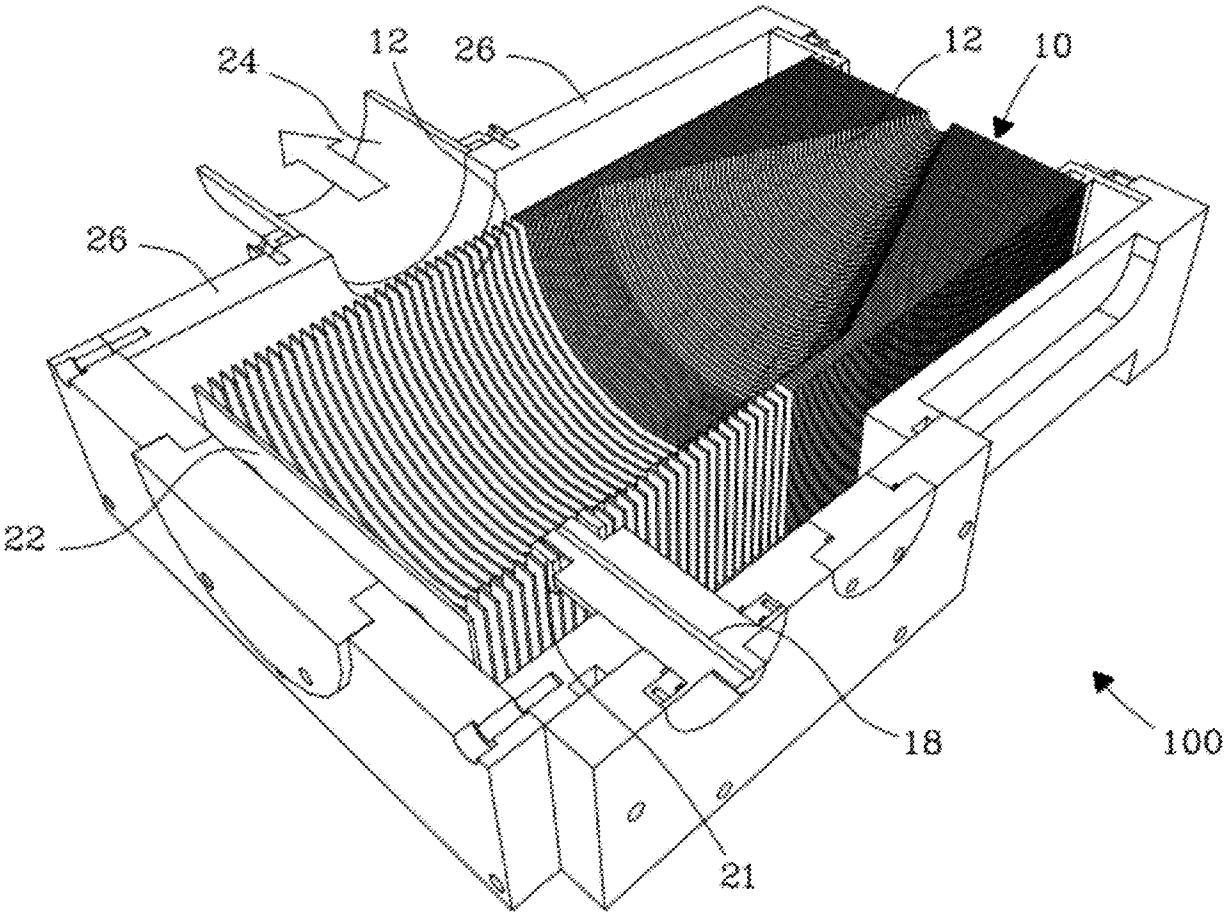

FIG. 3*b* shows an exemplary instrument setup incorporating the orthogonal ion injection device 100 of the invention configured with an inlet capillary 18. In the instant embodiment, ion guide 10 is an electrodynamic ion funnel 10 that includes a top (extension) portion 26 and a bottom portion 28. Bottom portion 28 includes a tapered end configured with ring electrodes 12 that include increasingly smaller diameters that terminate with a conductance limit (C.L.) electrode lens 15. The conductance limit electrode 15 allows interfacing of the orthogonal ion injection device 100 to downstream instrument stages including, e.g., ion guides, mass spectrometers (MS) of any type, and various mass spectrometer components, e.g., detectors and like components, which components are not limited. In some embodiments, ion guide 10 is enclosed within an ion guide chamber 26 or other enclosure. Ion guide chamber 26 includes a pumping port 24 that facilitates removal of liquid droplets and excess gases that accumulate in ion guide 10. The inlet capillary 18 is placed inside the ion guide 10 such that ions are directly injected into appropriately directed DC and RF fields inside the ion guide 10, which results in efficient ion confinement within the ion guide 10. Any large (e.g., 1 mm) liquid droplets received from the ionization source (e.g., an ESI source) through the inlet capillary 18 into the ion guide 10 are directed out of the ion guide 10 through pumping port 24 or another opening on the opposite side of the ion guide 10. In the preferred embodiment, pumping port 22 is preferably positioned on the wall of the ion guide chamber 26 directly opposite inlet capillary 18, but location is not intended to be limited. For example, pumping port 24 can be positioned anywhere about the perimeter of the ion guide 10 (e.g., from 0 to 360 degrees) at the same level (i.e., not offset from) or at a different level (i.e., offset from) from inlet opening 20. The strong directional gas flow at the end of the inlet capillary 18 carries liquid droplets out of the funnel, while strong DC and RF fields divert ions into the ion guide 10 along the ion guide axis 16. Both larger I.D. (e.g., 1 mm) single inlet capillaries and multiple inlet capillaries, which deliver greater gas loads, can be used with the invention. In some embodiments, a first ion guide 10 is coupled to a second ion guide 10 positioned downstream from the first ion guide 10, e.g., in a tandem ion guide configuration. In one embodiment, the first ion guide 10 is at a higher pressure (e.g., 4 Torr to about 30 Torr) and the second ion guide 10 is at a lower pressure (e.g., 1 Torr to about 4 Torr), but pressures are not limited thereto. In other embodiments, ion guides will include electrode lenses that have an equal diameter. In yet other embodiments, ion guides include various ion transmission portions of various designs. In yet other embodiments, ion guides include ion traps. In some embodiments, ion guides include combinations of these various ion guides and various mass spectrometers and like components. No limitations are intended.

Figure 3C:
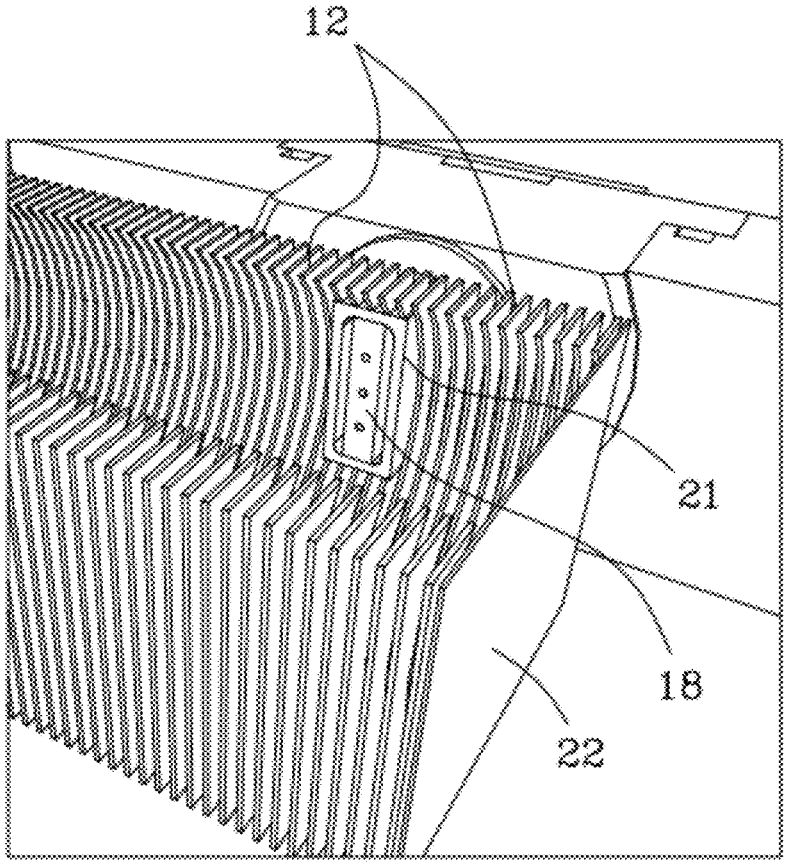

FIG. 3*c* shows a close-up view of the inlet opening 20 positioned on a side of the ion guide 10 that is further configured with a multiple inlet capillary 18. In the figure, the multiple inlet capillary 18 includes three (3) channels, but is not limited thereto. Capillaries are preferably stacked one atop the other such that each channel delivers a stream of ions that is mutually exclusive from (i.e., does not interfere with) other streams of ions introduced into ion guide 10. In the figure, inlet opening 20 is shielded externally and internally with an insulating material 21 to prevent electrical discharge between the inlet capillary 18 and adjacent ion guide electrodes 12 that can hinder movement of ions into ion guide 10. In the figure, inlet opening 20 is shown positioned between electrode lens number 13 and electrode lens number 18 of the ion guide 10, but construction is not intended to be limited. In general, number of electrode lenses 12 placed above inlet capillary 18 and opening 20 has a preferred ratio with electrodes placed below inlet capillary 18 and opening 20 of about ⅓ to about ⅔, respectively, but this ratio is not intended to be limited. Inlet opening 20 into ion guide 10 has a width equal to the width of an odd number of electrode lenses 12 (i.e., 1, 3, 5, 7, etc.) such that electrode lenses 12 on either side of opening 20 have a matching RF phase (+ or −). Matching the RF-phasing eliminates undesirable electric fields in the vicinity of the inlet opening 20. In the instant embodiment, number of electrode lenses 12 placed in the ion guide 10 above inlet opening 20 has a preferred length of about 1.5 cm to about 2.0 cm, as measured from the first ion guide electrode 13 to the center of opening 20, but is not limited thereto.

Figure 3D:
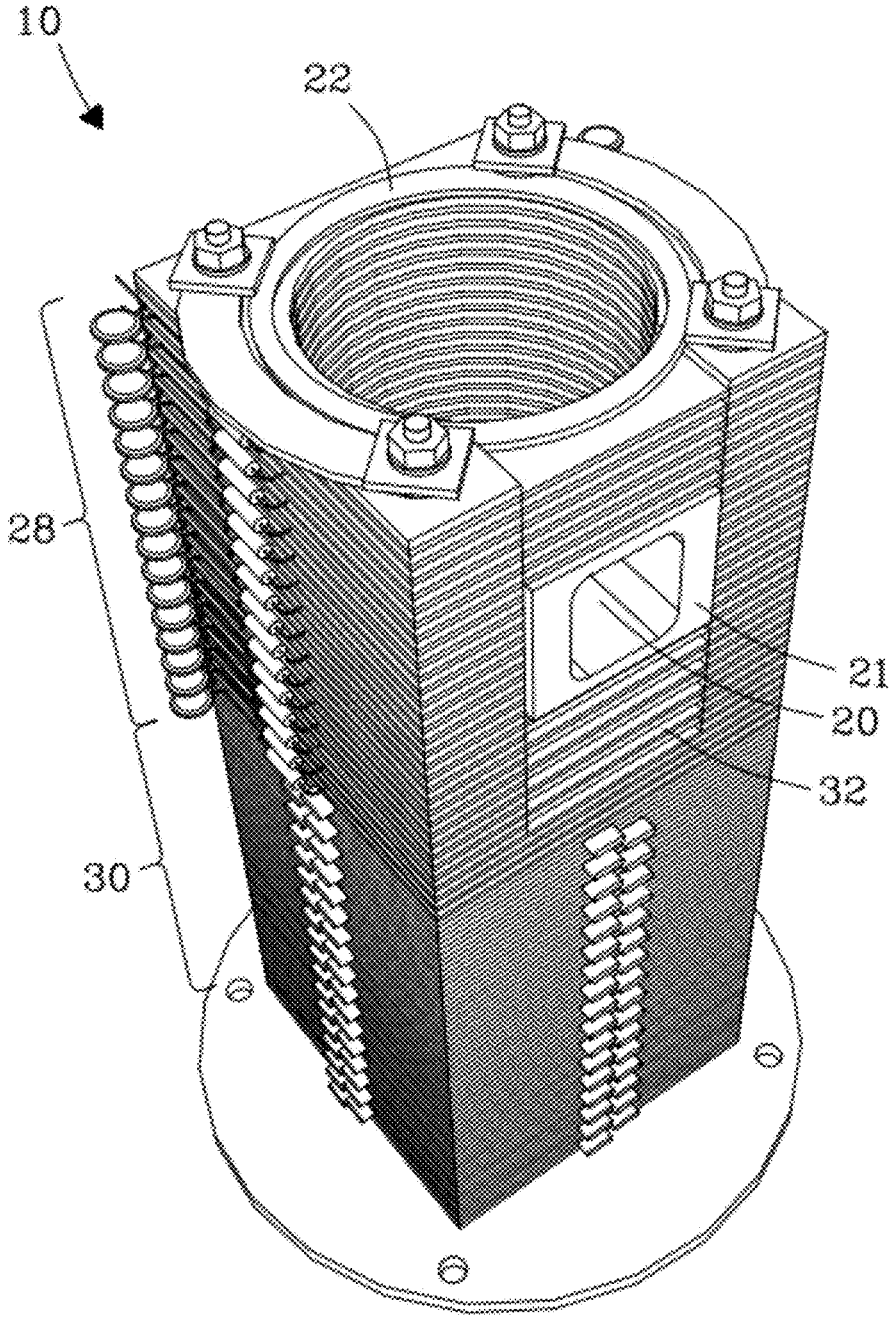
Figure 4A:
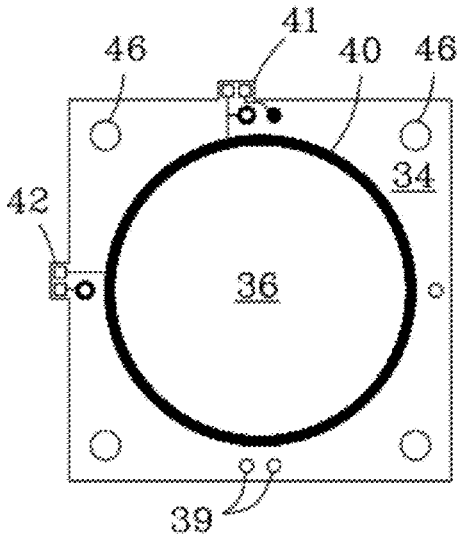
FIGS. 4*a*-4*d* show exemplary printed circuit boards for construction of one embodiment of the invention.
Figure 4B:
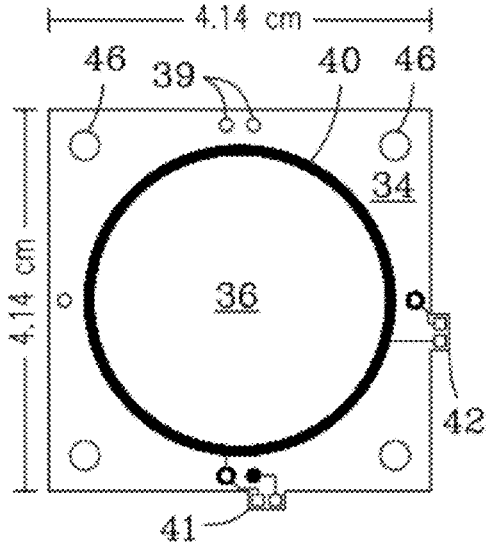
Figure 4C:
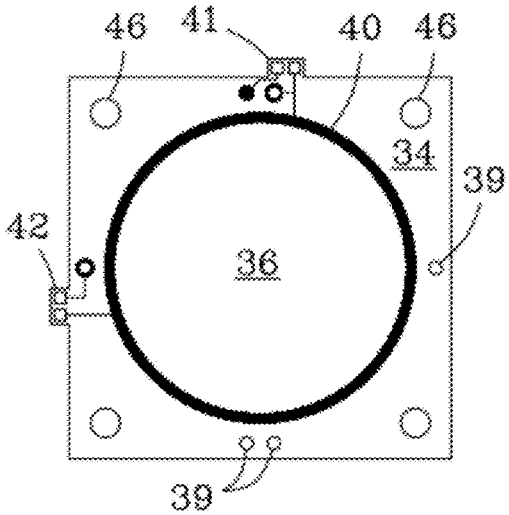
Figure 4D:
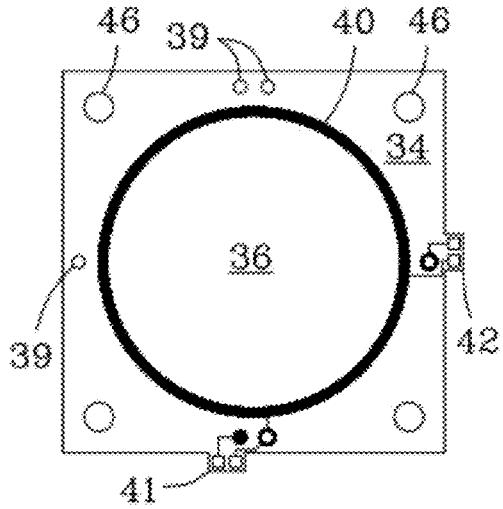

FIG. 3*d* shows a perspective view of an exemplary embodiment of the orthogonal ion injection device 100 of the invention. Orthogonal ion injection device 100 includes an ion guide 10. While the present embodiment is shown with a single type of ion guide, the invention is not limited thereto, as described herein. In the instant embodiment, ion guide 10 includes an extension (top) portion 28 and a bottom converging portion 30. In the instant embodiment, extension (top) portion 28 defines a region in front of ion guide 10 that measures about 4 cm to about 5 cm, where ions are first injected into the ion guide 10. Inlet capillary 18 inserts through an opening 20 on one side of the ion guide 10 at a distance of about 1.5 cm to about 2.0 cm downstream from the first electrode lens 13, but position is not limited. In the instant embodiment, extension (top) portion 28 of ion guide 10 includes brass electrode lenses 12 with a maximum inner diameter of 3.30 cm (1.3 inches). Thickness is 0.5 mm. Diameters are not limited. Length of the extension portion 28 is 5.3 cm, but is not limited. For extension portion 28, two 0.5 mm Teflon spacers (not shown) are placed between brass electrode lenses 12 for a total spacing 32 of 1.0 mm between electrodes 12 that allows pumping to remove liquid droplets and excess gases from ion guide 10. In the instant embodiment, bottom portion 30 includes electrode lenses 12 constructed on printed circuit boards (PCBs). In the instant embodiment, PCB electrode lenses 12 are of a square design with an exemplary dimension of 4.14 cm×4.14 cm, which dimensions are not limited. The PCB electrode lenses 12 have a maximum inner diameter of 3.05 cm (1.2 inches), which is not limited. Thickness is 0.5 mm. Bottom section 30 includes PCB spacers 32 (thickness of ~0.64 mm) placed between PCB funnel electrodes 12, but is not limited. Length of the PCB guide section 30 is about 7.2 cm, which length is not limited. The complete ion guide 10 of the instant embodiment is constructed of 35 brass electrodes 12 and 58 PCB electrodes 12, but the invention is not limited thereto. For example, in some embodiments, ion guide 10 is constructed entirely of PCB electrodes 12. In a preferred embodiment, spacing 32 between electrodes 12 permits removal of liquid droplets and excess gases from two respective sides along the complete length of the ion guide 10. In upper (top) extension portion 28, DC potentials are supplied by standard resistor chains as described previously herein. In the exemplary implementation, resistors in upper (top) extension portion (region) 28 are soldered to each electrode 12, but construction is not limited thereto. For example, in a preferred embodiment, electrode lenses 12 of ion guide 10 are constructed on PCBs with resistors mounted on each PCB electrode 12. RF potentials are provided by a standard capacitor network described previously herein. In the exemplary implementation, capacitors are soldered to each electrode 12, but construction is not limited thereto. For example, in preferred embodiments, capacitors (not shown) in bottom portion 30 are mounted on PCB boards, e.g., as described hereafter. In the present embodiment, two DC potentials are applied to the orthogonal injection ion guide 10. For the extension region 28, a first higher DC field (~20-50 V/cm) is typically applied, but is not limited. For bottom portion 30, a lower DC field (~10-15 V/cm) is typically applied, but is not limited. RF potentials for ion guide 10 are typically selected between about 100-200 $V_{p-p}$, that depend in part on the operating pressure. In some embodiments, higher RF potentials are necessary. For example, at greater pressures, a greater RF frequency and higher RF potential are required. In some embodiments, an RF potential of about 200 $V_{p-p}$ is used, with an RF frequency of about 1 MHz. No limitations are intended.

Electrical coupling between respective electrode lenses 12 is achieved using, e.g., spring-loaded, gold-coated metal pins (e.g., POGO™ Pins), e.g., as described hereafter. In the figure, inlet opening 20 is shown with the external shield (covering) 21. Shield 21 is composed preferably of poly-ethyl-ether-ketone also known as PEEK® (McMaster-Carr, Robbinsville, N.J., USA) or another suitable insulating material. In the figure, a repeller electrode 22 is positioned at the front end of ion guide 10. In some embodiments, repeller electrode 22 preferably includes a grid (not shown) composed of a metal mesh (e.g., micro-mesh) that provides a selected transmission efficiency (e.g., a 90% transmission grid, Bukbee-Mears, Minneapolis, Minn., USA). Any metal mesh with suitable transmission efficiency can be used. In other embodiments, repeller electrode 22 is a solid metal plate. No limitations are intended.

FIGS. 4*a*-4*d* show representative printed circuit boards (PCBs) 34 for constructing an orthogonal ion injection device, according to another embodiment of the invention. PCBs 34 (Imagineering, Inc., Elk Grove Village, Ill., USA) are constructed of standard insulating dielectrics (e.g., glass fibers) combined with epoxy resin materials known in the semiconductor and electrical circuit fabrication arts that deliver desired thermal and dimensional stability. PCBs 34 are composed of an electrically non-conducting insulating material as will be known by those of ordinary skill in the electrical fabrication arts. In the instant embodiment, PCBs 34 are of a square design, with a length on a side of 4.14 cm, but lengths are not limited. In some embodiments, PCBs 34 include a non-limiting thickness of about 0.6 mm. In the figure, PCB 34 includes a center opening 36 that defines an electrode lens 12 of an ion guide that includes dimensions of various sizes. Sizes are not limited. In some embodiments, maximum diameter of the electrode lenses 12 is preferably about 2 inches (5.08 cm). In some embodiments, minimum diameter of the electrode lenses 12 is 2.5 mm. Individual PCBs 34 are preferably coupled using spring-loaded coupling pins 38 (e.g., POGO™ pins, Mill-Max Manufacturing Corp., Oyster Bay, N.Y., USA) having preselected lengths that establish a connection between two printed circuit boards (PCB)s, or another suitable coupling configuration. Electrode lens 12 includes an electrically conducting material 40 that is electroplated around the perimeter of center opening 36 along the outer edge of electrode 12 that defines an outer diameter (O.D.) and an inner diameter (I.D.) of PCB electrode lens 12. PCBs 34 further include metal pads 41, 42 made or coated with electrically conducting materials 40 including, but not limited to, e.g., nickel (Ni), copper (Cu), silver (Ag), and gold (Au), or combinations of these various metals, positioned at various locations on each PCB 34. Metal pads 41, 42 further include electrical traces for contacting coupling pins. Coupling pins are introduced through holes 39 (~1.6 mm I.D.) introduced in PCBs 34. Coupling pins typically take the form of a slender cylinder containing two sharp, spring-loaded pins. Pins are durable, hard, and plated with a metal (e.g., gold) that provides reliable electrical contact and conductivity. Springs (not shown) of coupling pins do not carry signal. In a typical construction, coupling pins have a dimension defined by the separation distance between two electrodes lenses 12, but construction is not limited thereto. In some embodiments, coupling pins are inserted between two electrode lenses 12. Tips at the ends of the coupling pins contact and complete the circuits traced on each PCB 34. Pins of various lengths may be used and coupling of circuits on various electrodes can occur in various and different ways. For example, when coupling pins are used that have a greater length dimension than the width of a single PBC electrode, adjacent electrode lenses may be coupled to connect electrical circuits. For example, in the exemplary embodiment, electrical contacts for respective pairs of electrode lenses are traced on alternating electrode pairs (e.g., first and third, second and fourth, third and fifth electrodes, etc.) in an alternating pattern. In this embodiment, coupling pins are about 3.5 mm when fully extended and 2.5 mm when compressed. Pins are slightly conical, with a top dimension (outer diameter) of about 1.9 mm, and a tip dimension of about 1 mm (outer diameter). No limitations are intended. All electrical circuit designs as will be implemented by those of ordinary skill in the art in view of the disclosure are within the scope of the invention. In the figure, DC potential is supplied by a standard resistor chain described previously. Resistors attach to a receiving pad 41 on PCBs 34. RF potential is supplied by a standard capacitor network described previously. Capacitors attach to a separate receiving pad 42 on PCBs 34. Four (4) holes 46 (0.26 inch O.D.) positioned at respective corners of each PCB 34 through which a non-conducting, ceramic tube (0.25 inch O.D. and 0.125 inch I.D., McMaster-Carr, Robbinsville, N.J., USA) (not shown) is inserted to mount PCBs that forms the PCB ion guide. A threaded metal rod (4-40 thread) (not shown) is inserted through each ceramic tube to which a lock washer and threaded nut are attached, which completes construction of ion guide.

Orthogonal Injection

The invention is compatible with both single inlet capillaries, as well as multiple inlet capillaries that deliver higher gas loads at both high pressures and low pressures and provide significantly enhanced ion utilization by delivering ions directly into the ion guide. The present invention is compatible with all ionization sources including, but not limited to, e.g., Electrospray Ionization (ESI) sources, Matrix-Assisted Laser Desorption Ionization (MALDI) ion sources, Desorption Electrospray Ionization (DESI), or another ionization source. The present invention is also compatible with various mass spectrometers and systems that incorporate ion guides as a first stage of ion introduction into a mass spectrometer (MS). Mass spectrometers include, but are not limited to, e.g., time-of-flight mass spectrometers, quadrupole mass spectrometers, ion trap mass spectrometers, Orbitrap™ mass spectrometers, Fourier Transform Ion Cyclotron Resonance (FT-ICR) mass spectrometers, including combinations of these various spectrometers and components thereof.

Operation Parameters

Figure 5:
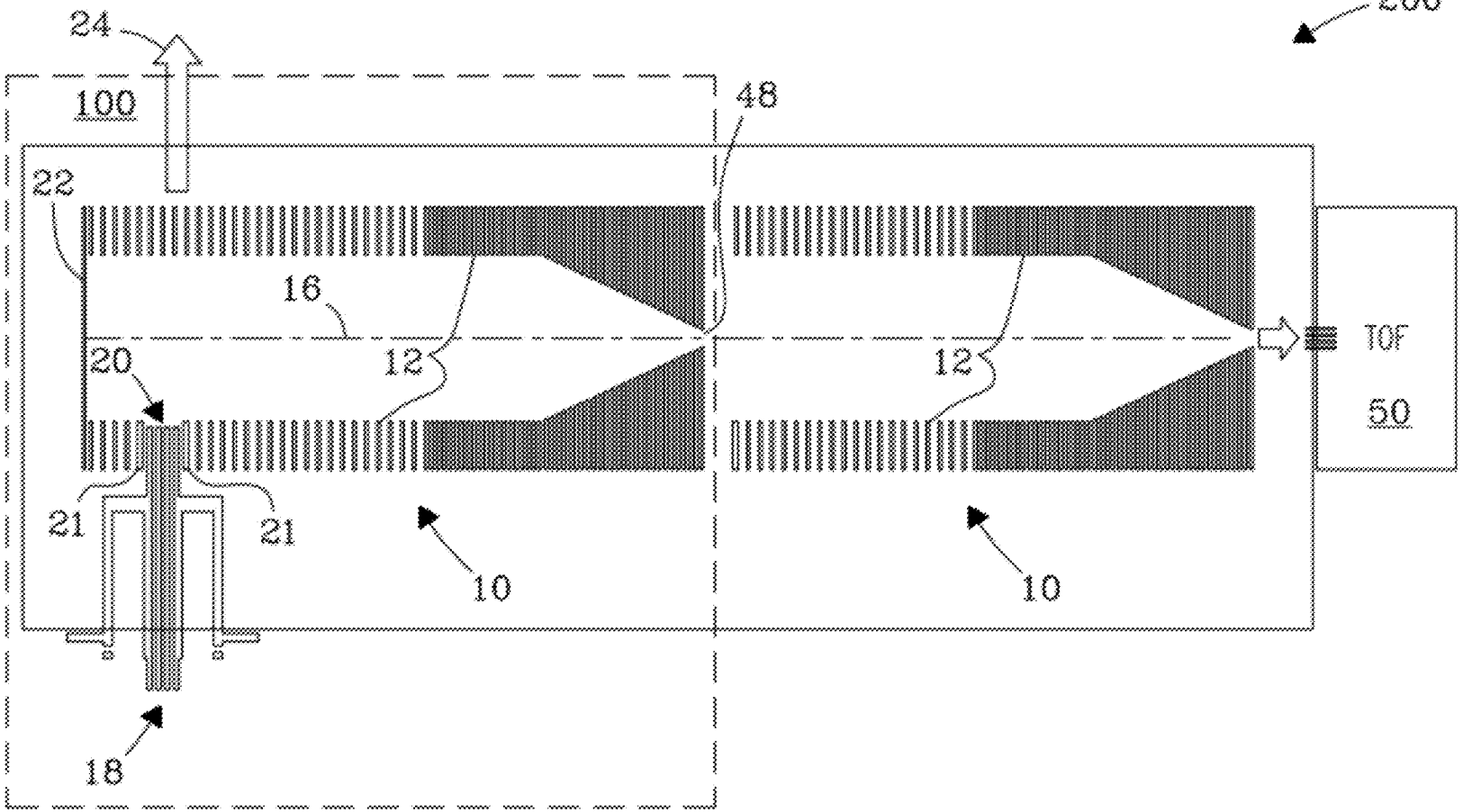
FIG. 5 shows an instrument system setup incorporating an embodiment of the invention.

FIG. 5 shows an exemplary system 200 incorporating the orthogonal ion Injection device 100 of the invention, according to an embodiment of the invention. In the figure, orthogonal ion injection device 100 is configured in a tandem ion funnel configuration with a first higher pressure ion funnel 10 and a second lower pressure ion funnel 10 both operated in transmission mode. Orthogonal ion injection device 100 is coupled to an ESI source (not shown). Thus, no carrier gas is used. Atmospheric air is delivered into the first ion funnel 10 along with ions from the ESI source. In the figure, a multiple inlet capillary 18 is shown, but the instrument can be used with both single inlet capillaries and multiple inlet capillaries. In the exemplary design, multiple inlet capillary 18 includes 3-channels and is heated. In one exemplary operation, RF potential is the same for all electrodes (e.g., ~200 $V_{p-p}$). DC potentials applied to adjacent electrodes vary and determine the DC field applied to the extension region. Flow rates are those typically selected for nanoESI experiments, but are not limited thereto. In exemplary tests, sample was flowed through the fused silica ESI tip at a sample flow rate of about 300 nL/min into the multiple inlet capillary. In some embodiments, flow rates from about 50 nL/min to about 500 nL/min are used. In other embodiments, flow rates above 500 nL/min are used. In exemplary tests, inlet voltage of the inlet capillary 18 was 400 Volts, but is not limited. Orthogonal ion injection device 100 includes a repeller electrode 22 on which both a DC potential and an RF potential are applied. In typical operation, DC voltage on electrode lenses 12 of the ion guide 10 varies depending on the mass spectrometer selected. In the present embodiment, a time-of-flight (TOF) mass spectrometer (MS) 50 was used, but is not intended to be limited thereto. Ion guides placed immediately after the ionization source carry ions into the mass spectrometer. DC potentials are selected such that the last electrode of the ion guide is slightly greater than the DC voltage on any subsequent electrode lens, e.g., of a second ion guide positioned downstream of the first ion guide. In exemplary tests, repeller electrode 22 included a DC potential of 470 volts, with a DC field between the repeller electrode 22 and the first funnel electrode 13 of about 100 V/cm. Typical voltage on the first electrode lens 13 of the higher pressure ion guide 10 in the extension region 26 was 460 volts. Voltage at the exit 48 of the higher pressure ion guide 10 was typically 237 volts. DC potential in the top (extension) region 28 was operated from about 50 V/cm down to about 20 V/cm. DC field for PCB region (bottom portion) 30 was about 8 V/cm. In some tests, potential was preferably selected between about 14 V./cm and about 23 V/cm. RF potential was preferably run at about 200 $V_{p-p}$, with an RF frequency of about 1 MHz. In system 200, orthogonal ion injection device 100 further included a pump (e.g., an Edwards M28 pump, Edwards Vacuum, Crawley, UK) (not shown) for pumping in chamber 26 of higher pressure ion guide 10, which displaces gas at a capacity of, e.g., 38.9 $m^3$/h. Pressure in the higher pressure ion guide 10 was held at 9 Torr. Pressure in the lower pressure guide 10 was held at about 1.0 Torr. While exemplary parameters are described, operation parameters are not limited thereto. RF potential for the higher pressure ion guide 10 in the orthogonal configuration was ~1 MHz and provided a peak-to-peak voltage ($V_{p-p}$) amplitude of from about 200 $V_{p-p}$ to about 250 $V_{p-p}$. Peak-to-peak voltage changes depending on the pressure in the respective chambers. For example, a higher frequency and amplitude are required for operation at higher pressures. As defined herein, higher pressures are pressures from about 4 Torr to about 30 Torr. As defined herein, lower pressures are pressures from about 1 Torr to about 4 Torr. At higher pressures, RF potential and frequency are linearly increased. RF potential for the lower pressure ion guide 10 was ~600 KHz and provided a peak-to-peak voltage ($V_{p-p}$) amplitude of from about 80 to about 100 $V_{p-p}$. In the instant embodiment, RF phasing on adjacent electrodes was of an opposite phase.

Limits of Detection

Figure 6:
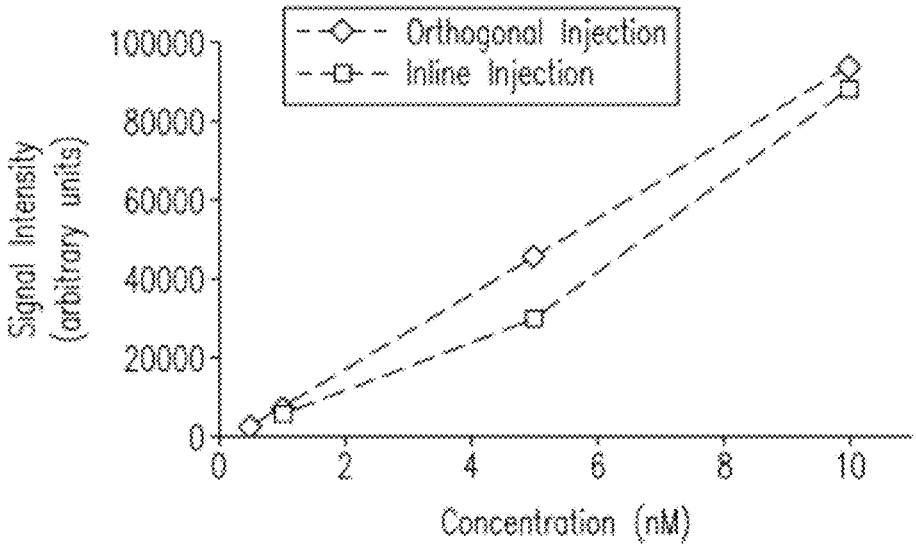
FIG. 6 compares limits of detection (LODs) for an embodiment of the invention against conventional inline injection.

FIG. 6 compares limits of detection (LODs) for an embodiment of the invention as a function of concentration against conventional inline injection. Samples containing a mixture of various sample peptides at 5 different concentrations (0.1 nM, 0.5 nM, 1.0 nM, 5.0 nM and 10 nM) were prepared in a water:methanol:acetic acid (49.5:49.5:1% by volume) solution. Peptides included: Angiotensin I (SEQ. ID. NO.: 1), Fibrinopeptide-A (SEQ. ID. NO.: 2), Bradykinin (SEQ. ID. NO.: 3), Angiotensin II (SEQ. ID. NO.: 4), Neurotensin (SEQ. ID. NO.: 5), and Substance P (SEQ. ID. NO.: 6). Flow rates for both orthogonal injection tests and conventional inline ion injection tests were held constant at 300 nL/min. Signal intensities for the present invention are comparable to, or better than those obtained with inline injection. Signal-to-noise levels are better for orthogonal injection by a factor of about 1.5 to 2. And, orthogonal injection eliminates or minimizes contamination of downstream components.

Figure 7:
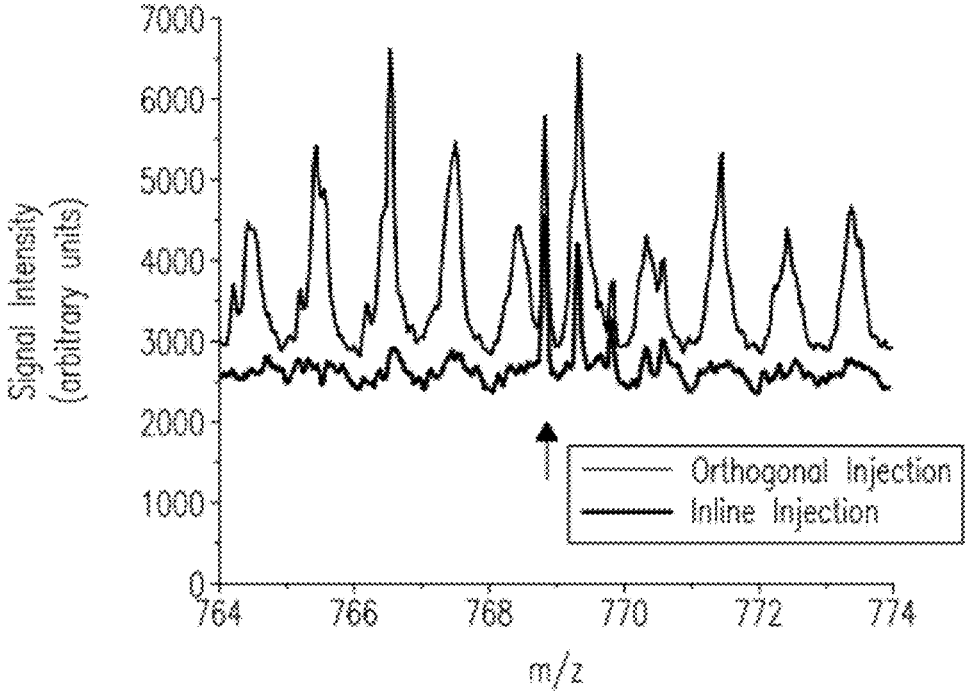
FIG. 7 compares limits of detection (LODs) an embodiment of the invention for Fibrinopeptide-A on (SEQ. ID. NO.: 2) against conventional inline injection.

FIG. 7 compares limits of detection (LODs) for an embodiment of the orthogonal ion injection device for a given ion, e.g., $[\text{Fibrinopeptide-A}]^{2+}$ ion (SEQ. ID. NO.: 2) [(m/z) =768.8] compared with conventional inline injection. In the figure, results for $[\text{Fibrinopeptide-A}]^{2+}$ (SEQ. ID. NO.: 2) are shown at an analyte concentration of 0.5 nM. In the figure, background chemical noise for the invention is significantly lower than for the conventional inline approach. The arrow in the figure shows the peak position for the monoisotopic Fibrinopeptide A ion (SEQ. ID. NO.: 2), the analyte of interest. Resolution of the analyte peak of interest is distinguished from the chemical background, even at the low analyte concentration, which is not observed with the conventional inline approach. Results show that orthogonal injection provides enhanced signal intensity for the analytes of interest compared with inline injection. In the figure, orthogonal injection exhibits an enhanced signal-to-noise ratio of about 10.2 to 2.4 (~4:1) compared with the inline injection approach.

TABLE 1 lists signal-to-noise (S/N) values for an embodiment of the orthogonal ion injection device against conventional inline injection for an eight peptide mixture at a concentration of 5 nM.

TABLE 1

Signal-to-Noise Values for Orthogonal Injection embodiment compared with conventional Inline injection for 5.0 nM samples.

| Ion | (m/z) | Orthogonal (S/N) | Inline (S/N) | Ratio (Orthogonal/Inline) |
|---|---|---|---|---|
| Bradykinin (SEQ. ID. NO.: 3) | 530.8 | 10.9 | 9.7 | 1.13 |
| Neurotensin (SEQ. ID. NO.: 5) | 558.3 | 26.9 | 12.1 | 2.22 |
| Substance-P (SEQ. ID. NO.: 6) | 674.3 | 20.8 | 11.4 | 1.82 |

TABLE 1-continued

Signal-to-Noise Values for Orthogonal Injection embodiment compared with conventional Inline injection for 5.0 nM samples.

| Ion | (m/z) | Orthogonal (S/N) | Inline (S/N) | Ratio (Orthogonal/Inline) |
|---|---|---|---|---|
| Fibrinopeptide-A (SEQ. ID. NO.: 2) | 768.8 | 95.4 | 32.7 | 2.91 |

Direct comparison between inline and orthogonal injection methods shows orthogonal injection of the present invention to be about as efficient, or better than, those obtained with inline injection. Close inspection of individual peptides showed variable results, in which some peptides gave more intense signals for orthogonal injection, especially when deployed in concert with multiple inlet capillaries.

Figure 8:
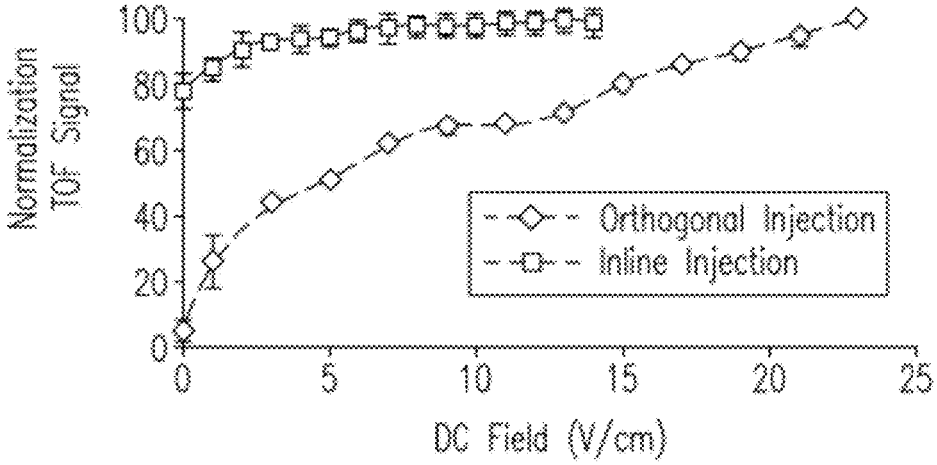
FIG. 8 compares effect of DC fields on signal intensity for an embodiment of the invention against conventional inline injection.

FIG. 8 compares effect of DC fields on signal intensity for an embodiment of the invention against conventional inline injection. Results show that for conventional inline injection, ~87% of contents (including charged liquid droplets, and ESI buffer ions) introduced to the on funnel pass into the downstream MS, regardless of the DC field. In contrast, results show the orthogonal injection device of the invention delivers less than 5% of charged liquid droplets and ESI buffer ions into the downstream MS, even at a DC field of zero (i.e., "0") V/cm. Thus, the invention minimizes potential for contamination in downstream instrument components and elements.

Signal Intensity

Figure 9:
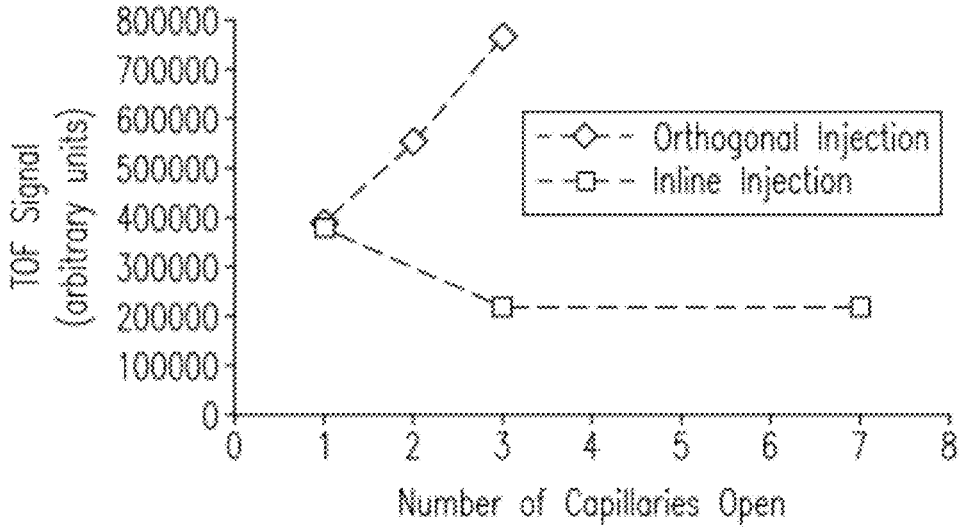
FIG. 9 compares signal intensity for an embodiment of the invention against conventional orthogonal ion injection.

FIG. 9 compares signal intensity for an embodiment of the invention as a function of the number of inlet capillaries configured in a time-of-flight (TOF) mass spectrometer system against a Bruker Daltonics orthogonal ion injection approach known in the prior art. Results show that while signals for a single inlet capillary are similar for both the invention and the prior-art approach, signal intensities for the two approaches differ significantly. For example, at an (m/z) of 922, the orthogonal approach of the invention (e.g., configured with three inlet capillaries) provides an ion signal intensity that is 4 times that of the orthogonal injection approach of the prior art (i.e., 800,000:200,000).

Stability

Figure 10:
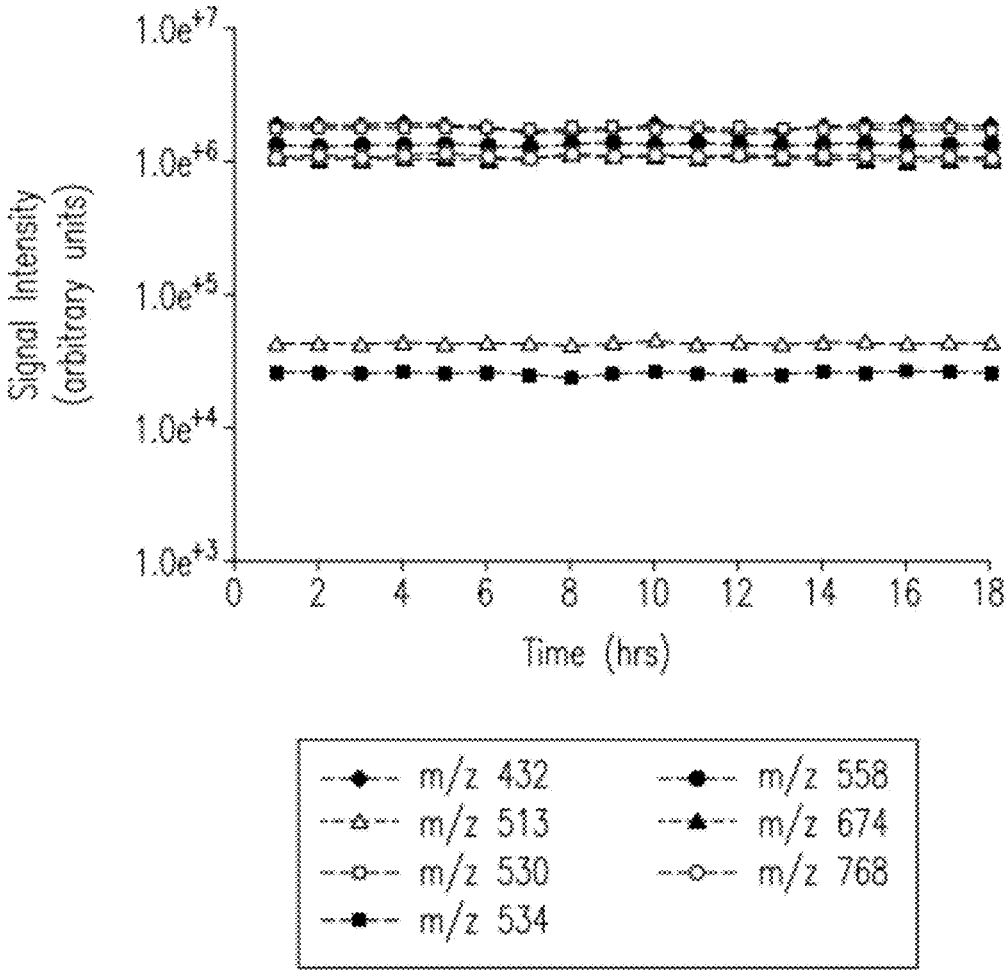
FIG. 10 compares ion signal stability for an embodiment of the invention in a mass spectrometer system as a function of time.

FIG. 10 compares stability of the ion signal for an embodiment of the orthogonal injection of the invention in a mass spectrometer system as a function of time for a sample containing a mixture of 9 peptides. Peptides were prepared at a concentration of 100 nM in a water:methanol:acetic acid (49.5:49.5:1% by volume) solution. Orthogonal injection was carried out at a flow rate of 300 nL/min. Results show ion signal is stable over a period at least about 18 hours.

While exemplary embodiments of the present invention have been shown and described, it will be apparent to those skilled in the art that many changes and modifications may be made without departing from the invention in its true scope and broader aspects. The appended claims are therefore intended to cover all such changes and modifications as fall within the spirit and scope of the invention.

SEQUENCE LISTING

```
<160> NUMBER OF SEQ ID NOS: 6

<210> SEQ ID NO 1
<211> LENGTH: 10
<212> TYPE: PRT
<213> ORGANISM: Homo sapiens

<400> SEQUENCE: 1

Asp Arg Val Tyr Ile His Pro Phe His Leu
1               5                   10


<210> SEQ ID NO 2
<211> LENGTH: 16
<212> TYPE: PRT
<213> ORGANISM: Homo sapiens

<400> SEQUENCE: 2

Ala Asp Ser Gly Glu Gly Asp Phe Leu Ala Glu Gly Gly Gly Val Arg
1               5                   10                  15


<210> SEQ ID NO 3
<211> LENGTH: 9
<212> TYPE: PRT
<213> ORGANISM: Homo sapiens

<400> SEQUENCE: 3

Arg Pro Pro Gly Phe Ser Pro Phe Arg
1               5


<210> SEQ ID NO 4
<211> LENGTH: 13
<212> TYPE: PRT
<213> ORGANISM: Homo sapiens

<400> SEQUENCE: 4

Glu Leu Tyr Glu Asn Lys Pro Arg Arg Pro Tyr Ile Leu
1               5                   10


<210> SEQ ID NO 5
<211> LENGTH: 8
<212> TYPE: PRT
<213> ORGANISM: Homo sapiens

<400> SEQUENCE: 5

Asp Arg Val Tyr Ile His Pro Phe
1               5


<210> SEQ ID NO 6
<211> LENGTH: 11
<212> TYPE: PRT
<213> ORGANISM: Sus scrofa

<400> SEQUENCE: 6

Arg Pro Lys Pro Gln Gln Phe Phe Gly Leu Met
1               5                   10
```

What is claimed is:

1. An in-guide orthogonal ion injection apparatus, comprising:

an ion guide chamber that encloses an ion guide during operation at a pressure in the range from about 0.1 Torr to about 30 Torr, the ion guide comprises a plurality of electrode lenses with an inlet capillary that inserts through an opening disposed on one side of the ion guide between two electrode lenses downstream from a first electrode lens of the ion guide that delivers ions into the ion guide orthogonal to the ion guide axis;

a shield comprising an insulating material that covers the inlet capillary through the opening into the ion guide that prevents discharge between the inlet capillary and adjacent ion guide electrodes; and a pumping port disposed on a wall of the ion guide chamber opposite the inlet capillary that removes liquid droplets and excess gas introduced to the ion guide through the inlet capillary;

whereby a preselected DC field and RF field applied to electrode lenses adjacent the shield on either side of the shield during operation injects ions introduced through the inlet capillary into the ion guide along the ion guide axis.

2. The apparatus of claim 1, wherein the inlet is a single inlet capillary.

3. The apparatus of claim 1, wherein the inlet is a multiple inlet capillary.

4. The apparatus of claim 3, wherein capillaries of the multiple inlet capillary are disposed vertically such that ions delivered through a first capillary are decoupled from ions delivered through a different capillary of the multiple inlet capillary.

5. The apparatus of claim 1, wherein the ion guide is selected from the group consisting of: ion funnels; ion funnel traps; S-lenses; conjoined stacked ring ion guides, and combinations thereof.

6. The apparatus of claim 1, wherein electrode lenses of the ion guide are disposed on one or more printed circuit boards.

7. The apparatus of claim 1, wherein the DC field and RF field are simultaneously applied to each of the electrode lenses of the ion guide.

8. The apparatus of claim 1, wherein the DC field applied to each of the electrode lenses of the ion guide is independently of the RF field applied to each of the electrode lenses of the ion guide.

9. The apparatus of claim 1, wherein the RF field on any electrode lens is 180 degrees out of phase with the RF field on an adjacent electrode lens in the ion guide.

10. The apparatus of claim 1, wherein the separation distance between adjacent electrode lenses in the ion guide defines a flow path for removal of liquid droplets and excess gases introduced from the inlet capillary.

11. The apparatus of claim 10, wherein the flow path for removal of liquid droplets and excess gases is defined along at least one side along the length of the ion guide or a portion thereof.

12. The apparatus of claim 1, further including a repeller electrode disposed in front of a first electrode lens of the ion guide that delivers a DC voltage and an RF frequency of a preselected amplitude that directs ions from the ion inlet capillary into the ion guide along the ion guide axis.

13. The apparatus of claim 12, wherein the repeller electrode comprises a metal mesh or a solid metal plate.

14. The apparatus of claim 1, wherein the ion guide is a tandem ion guide that includes a first ion guide disposed in a first vacuum chamber at a first higher pressure and a second ion guide disposed in a second vacuum chamber at a second lower pressure.

15. The apparatus of claim 14, wherein the second ion guide is an ion funnel trap.

* * * * *